US006936970B2

(12) United States Patent
Chen et al.

(10) Patent No.: US 6,936,970 B2
(45) Date of Patent: Aug. 30, 2005

(54) METHOD AND APPARATUS FOR A UNIDIRECTIONAL SWITCHING, CURRENT LIMITED CUTOFF CIRCUIT FOR AN ELECTRONIC BALLAST

(75) Inventors: Timothy Chen, Aurora, OH (US); James D. Mieskoski, Seven Hills, OH (US); Didier G. Rouaud, Twinsburg, OH (US); Scott Brandonisio, Solon, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/675,441

(22) Filed: Sep. 30, 2003

(65) Prior Publication Data

US 2005/0067967 A1 Mar. 31, 2005

(51) Int. Cl.[7] ..... H05B 37/02

(52) U.S. Cl. ..... 315/105; 315/106; 315/107; 315/209 R

(58) Field of Search ..... 315/105, 106, 315/107, 209 R

(56) References Cited

U.S. PATENT DOCUMENTS

| | | | | |
|---|---|---|---|---|
| 5,008,597 A | | 4/1991 | Zuchtriegel | |
| 5,491,386 A | * | 2/1996 | Eriguchi et al. | 315/209 R |
| 5,569,984 A | | 10/1996 | Holtslag | |
| 5,623,187 A | | 4/1997 | Caldeira et al. | |
| 5,796,216 A | | 8/1998 | Beasley | |
| 5,932,976 A | | 8/1999 | Maheshwari et al. | |
| 6,011,362 A | | 1/2000 | Moisin | |
| 6,020,691 A | | 2/2000 | Sun et al. | |
| 6,034,489 A | | 3/2000 | Weng | |
| 6,043,606 A | * | 3/2000 | Arts et al. | 315/94 |
| 6,184,630 B1 | | 2/2001 | Qian et al. | |
| 6,208,085 B1 | | 3/2001 | Lehnert et al. | |
| 6,337,800 B1 | | 1/2002 | Chang | |
| 6,417,631 B1 | | 7/2002 | Chen et al. | |
| 6,483,252 B2 | | 11/2002 | Bruning | |
| 6,495,971 B1 | | 12/2002 | Greenwood et al. | |
| 6,593,703 B2 | * | 7/2003 | Sun | 315/224 |
| 2002/0191429 A1 | | 12/2002 | Nadd et al. | |

* cited by examiner

*Primary Examiner*—David Vu
(74) *Attorney, Agent, or Firm*—Fay, Sharpe, Fagan, Minnich & McKee, LLP

(57) ABSTRACT

In accordance with one aspect of the present application, a lamp inverter circuit includes a switching portion that converts a bus voltage signal into an alternating current signal. An input portion receives the bus voltage signal, and a resonant load portion drives a lamp. A preheating portion heats the lamp prior to ignition, and thereafter renders itself inactive following ignition of the lamp. In accordance with another aspect of the present application, a method of starting a lamp includes receiving a bus voltage signal, converting the bus voltage signal into an alternating current signal, preheating the lamp to an ignition temperature, igniting the lamp and inactivating the preheating after the lamp has been ignited. In accordance with another aspect of the application, provided is a method of igniting an auxiliary lamp, including detecting a conductive state of a main lamp in a lamp ballast circuit, the detecting being by a switch that controls preheating of the main lamp. The integrity of the main lamp is detected, and current flow is switched from the main lamp to an auxiliary lamp in the event of a main lamp failure.

20 Claims, 5 Drawing Sheets

METHOD AND APPARATUS FOR A UNIDIRECTIONAL SWITCHING, CURRENT LIMITED CUTOFF CIRCUIT FOR AN ELECTRONIC BALLAST

BACKGROUND

The present application relates to ballasts, or power supply circuits for gas discharge lamps. It finds particular application for use with current fed instant and/or rapid start electronic ballasts or power supply circuits and will be described with particular reference thereto. It is to be appreciated, however, that the present application is also applicable to other controllers, and is not limited to the aforementioned use.

Presently there are two prevailing starting methods for starting gas discharge lamps. One is instant start, and the other is rapid start. In both the instant start and rapid start methods, cathodes of the lamp are pre-heated before lamp ignition. With an instant start electronic ballast, the cathodes are preheated by a glow discharge current. This is the current that goes through the lamp before the lamp ignites. Typically, the voltage potential of the glow discharge current is high, and can range between approximately 400 and 500 $V_{rms}$ or more. In the preheating phase, when the lamp is not conducting, such high potential differences can cause bombardment of the cathodes, resulting in some of the physical material of the cathode sputtering off each time the lamp is lit. Thus, lamps that utilize the instant start method of ignition tend not to have as long lives as lamps that utilize the rapid start method. Typically, a lamp that uses instant start will last about 80% as long as the same type of lamp using rapid start.

With a rapid start electronic ballast, the cathodes are pre-heated with a separate voltage on the cathodes, while maintaining low voltage across the lamp. Therefore, the glow discharge current is low, being less than about 10 ma in comparison with instant start circuits. In the rapid start mode, the time that high voltage potentials across the lamp are applied without the lamp conducting is significantly reduced during start-up, and the bombardment of the cathodes does not occur to the same extent as with the instant start method, significantly extending lamp life.

There is a drawback, however, to using the rapid start mode. Presently, once a preheating current is applied, it is generally not removed from the cathodes, even after the lamp ignites. Resultantly, while the lamp is lit, the low voltage heating current is continuously applied on the cathodes. Thus, lamps that utilize the rapid start method to start are consuming more power than lamps that use the instant start method. With a single lamp, it is likely that up to about 1.5 extra Watts of power will be consumed, and with a three lamp ballast, it is likely that between 4.5 and 6 extra Watts of power will be consumed. This extra power is consumed (simply producing heat) without producing any added light output, that is, without producing extra lumens. Thus, the trade-off from instant start to rapid start is greater lamp life for added power consumption.

BRIEF DESCRIPTION

In accordance with one aspect of the present application, a lamp inverter circuit includes a switching portion that converts a bus voltage signal into an alternating current signal. An input portion receives the bus voltage signal, and a resonant load portion drives a lamp. A preheating portion heats the lamp prior to ignition, and thereafter renders itself inactive following ignition of the lamp.

In accordance with another aspect of the present application, a method of starting a lamp includes receiving a bus voltage signal, converting the bus voltage signal into an alternating current signal, preheating the lamp to an ignition temperature, igniting the lamp and inactivating the preheating after the lamp has been ignited.

In accordance with another aspect of the application, provided is a method of igniting an auxiliary lamp, including detecting a conductive state of a main lamp in a lamp ballast circuit, the detecting being by a switch that controls preheating of the main lamp. The integrity of the main lamp is detected, and current flow is switched from the main lamp to an auxiliary lamp in the event of a main lamp failure.

DETAILED DESCRIPTION

Figure 1:
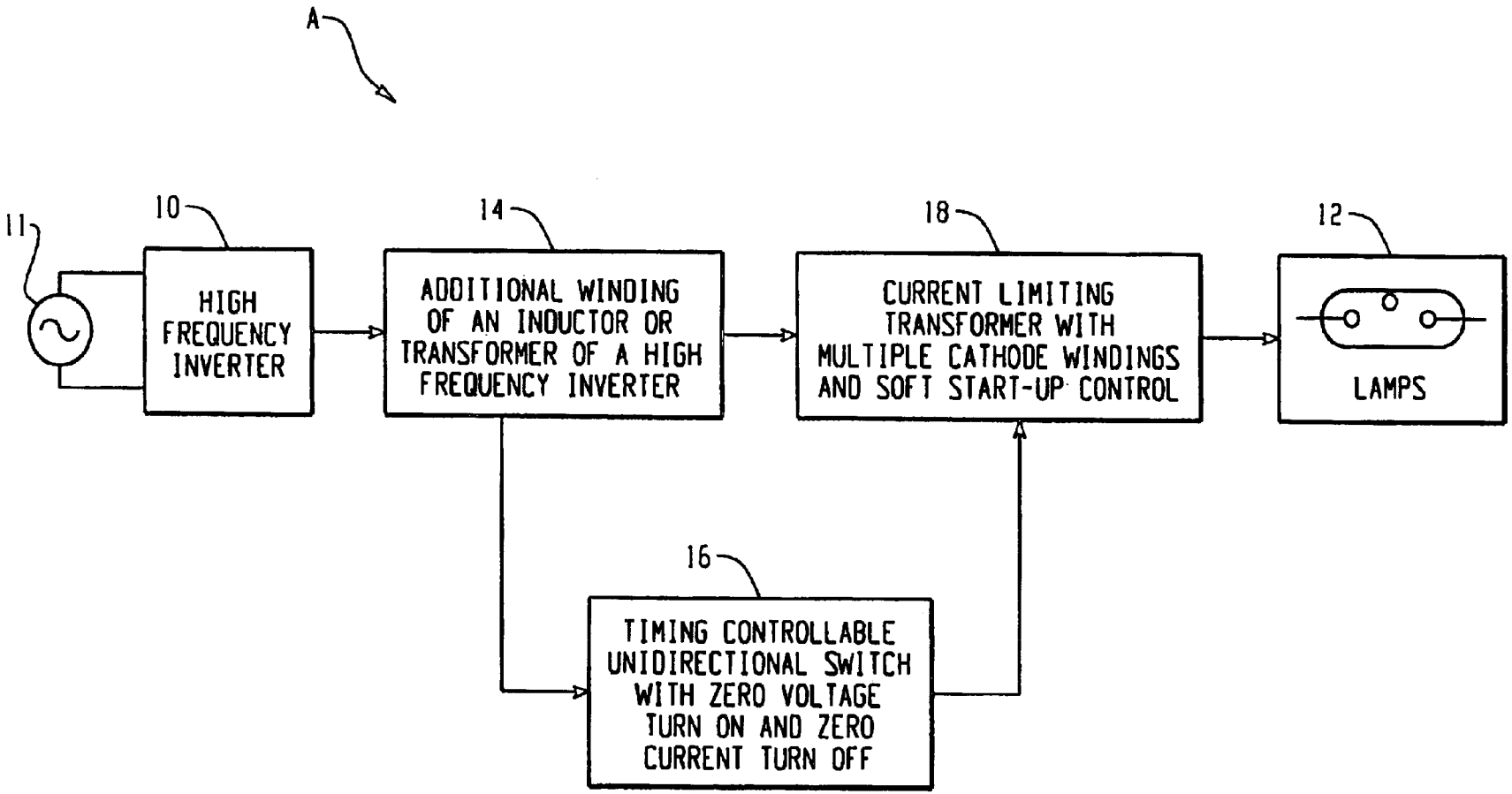
FIG. 1 is a block diagram of a lamp system in accordance with the present application.

With reference to FIG. 1, lamp circuit A includes a high frequency inverter 10, and a lamp assembly 12. Inverter 10 is supplied with a bus voltage 11, and can be either of a current fed or a voltage fed type of high frequency inverters. Both types of inverters utilize inductive circuitry, whether they be inductors or transformers. Tapped off of a portion of the inductive circuitry of inverter 10, are additional inductive winding of winding arrangement 14 that supply power to a unidirectional timing switch circuit 16. These windings supply power that will be used to pre-heat cathodes of lamp assembly 12. Two windings are used for each lamp, as each lamp has two cathodes to pre-heat. For a three lamp configuration, only four to six windings from inductive winding arrangement 14 are tapped off of inverter 10, since one cathode of the three lamps is in parallel and heated by a single winding.

Timing switch circuit 16 is selected to be unidirectional to avoid having to convert an AC control signal into a pulsating DC signal before being controlled by switch circuit 16. This makes for a simpler, lower cost switch arrangement, and aids in allowing the provision of power to the cathodes by a single switch.

The single switch of timing switch circuit 16 is selected to have a zero voltage turn-on point and a zero current turn-off point. This allows the switch to turn on without excessively high voltages. Otherwise, larger, more expensive switches would be needed to do the same job. Also, utilizing zero voltage turn-on and zero current turn-off minimizes power dissipation when the switch is activated or deactivated. Inverter 10 and timing switch circuit 16 are both gated by a current limiting transformer arrangement 18 that regulates the start-up and currents supplied to lamp cathode assembly 12.

Figure 2:
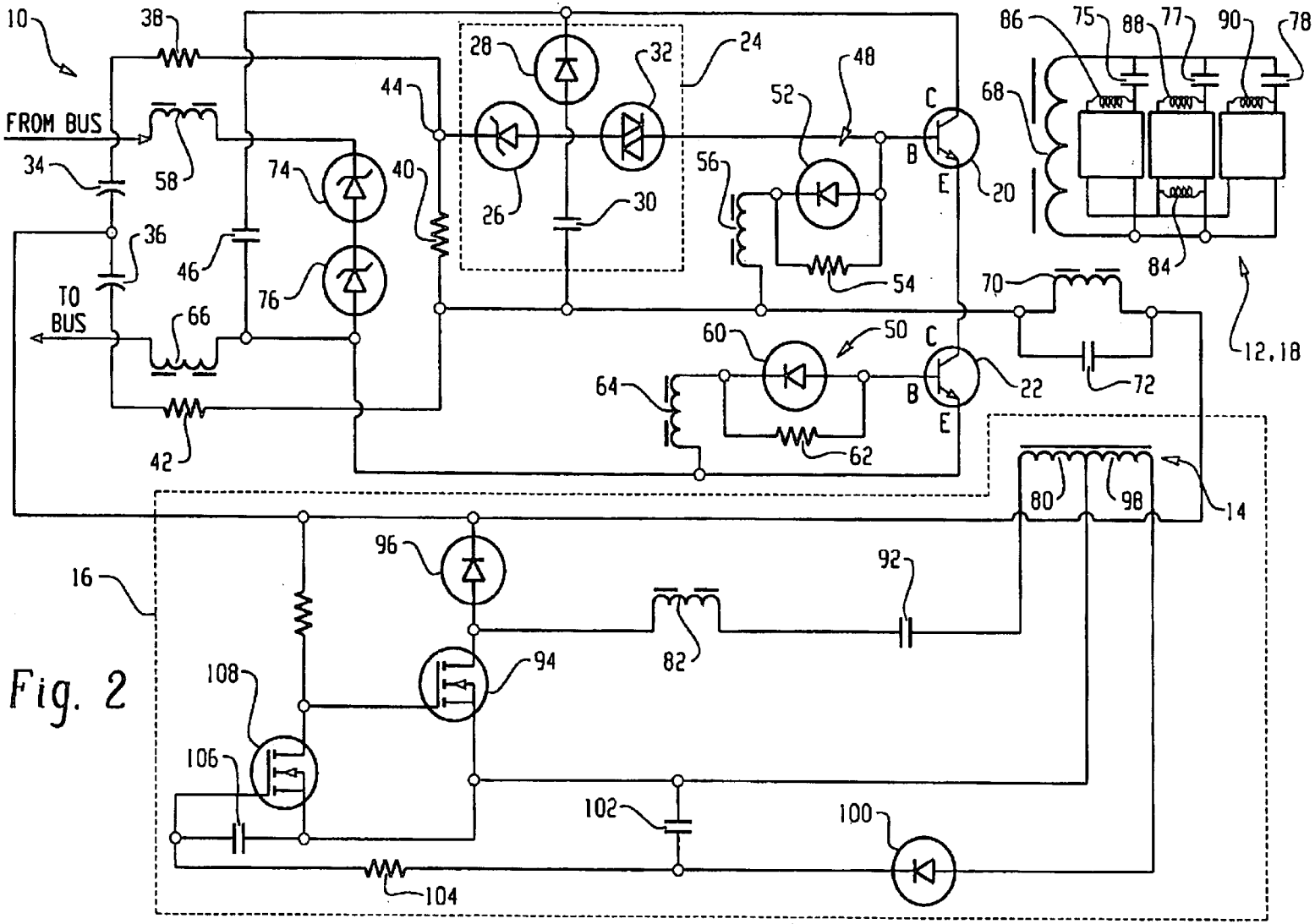
FIG. 2 is a circuit diagram of a ballast inverter circuit included in the lamp system shown in FIG. 1, in accordance with one aspect of the present application.

With reference to FIG. 2, illustrated is a more detailed view of the lamp circuit A including, inverter starting circuit 10 in a current fed half bridge inverter implementation, in operation with a cathode cut-off circuit, comprised of inductive winding arrangement 14, unidirectional timing switch circuit 16, and current limiting transformer arrangement 18.

In order to convert a DC bus signal into an AC signal, a first transistor 20 and a second transistor 22 alternate between periods of conductivity and periods of non-conductivity, out of phase with each other. That is, when the first transistor 20 is conductive, the second transistor 22 is non-conductive, and vice-versa. The transistors 20, 22 are part of a switching portion of the inverter circuit 10. The action of alternating periods of conduction of the transistors provides an AC signal to the lamp assembly 12. In the embodiment illustrated in FIG. 2, the transistors are bipolar junction transistors (BJTs), but it is to be understood the concepts of the present application may be incorporated in other switching networks, such as known in the art. For example, the following descriptions may be implemented with field effect transistors in both half-bridge current fed ballasts and push-pull type current fed electronic ballasts, among others.

In this embodiment, each transistor 20, 22 has a respective base, (B) emitter, (E) and collector (C). The voltage from base-to-emitter on either transistor defines the conduction state of that transistor. That is, the base-to-emitter voltage of transistor 20 defines the conductivity of transistor 20 and the base-to-emitter voltage of transistor 22 defines the conductivity of transistor 22. In the illustrated embodiment neither of the transistors 20, 22 are conductive when current is initially supplied to the inverter starting circuit 10. As will be expanded upon below, a start-up portion 24 of the inverter circuit prevents current from being supplied to the transistors 20, 22 before the bus voltage reaches a predetermined threshold voltage. The start-up portion includes Zener diode 26, diode 28, capacitor 30, and diac 32.

The potential difference across capacitors 34 and 36 is equivalent to the bus voltage. In one embodiment, capacitors 34 and 36 are of equal value, so that the voltage across capacitor 34 is the same as the voltage across capacitor 36. In parallel with capacitors 34 and 36 are resistors 38, 40, and 42. Resistors 38 and 40 form a voltage divider at node 44 and current is supplied to the start-up portion 24 through voltage divider 38, 40.

When power is first applied to the inverter starting circuit 10, Zener diode 26 and diode 28 prevent any significant current from passing through start-up portion 24. As the bus voltage ramps up, after power is initially supplied to inverter starting circuit 10, a portion of the circuit current charges capacitors 34 and 36, other current charges resonant capacitor 46, and the remaining current flows through resistors 38, 40, and 42. Initially, because half the bus voltage is divided by resistors 38 and 40, a breakdown voltage of Zener diode 26 is not reached, and Zener diode 26 prevents current from passing through start-up portion 24. Eventually, the bus voltage ramps to a level where the potential at node 44 is greater than the breakdown voltage of Zener diode 26 turning Zener diode 26 conductive, supplying increased current levels to start-up portion 24, and more specifically, to capacitor 30. In the illustrated embodiment, the breakdown voltage of Zener diode 26 is between about 60 to 80 V, and preferably 8V.

Once Zener diode 26 turns conductive (from left to right in FIG. 2) capacitor 30 begins charging. At this point, current is being supplied to start-up portion 24, but diac 32 prevents the base of transistor 20 from becoming conductive in the collector-emitter direction. As the bus voltage continues ramping up, capacitor 30 collects more charge, and eventually reaches a potential to overcome the breakover voltage of diac 32. When the breakover voltage is reached, transistor 20 turns conductive, wherein inverter starting circuit 12 begins to oscillate, and cathodes of lamp assembly 12 are preheated.

After the breakover voltage of diac 32 is reached, capacitor 30 no longer has an opportunity to continuously collect charge. Current flows directly from node 44 to the collector of transistor 20, since transistor 20 is conductive after diac 32 breaks down. Diode 28 provides a path to allow capacitor 30 to discharge, once per cycle. The inverter starting circuit 10 now operates as is typical, with no further activity from the start-up portion 24.

With continuing attention to FIG. 2, switching transistors 20, 22 are driven by respective drive circuits 48, 50. Drive circuit 48 incorporates diode 52, resistor 54 combination supplied via coupling of windings 56, 68. Drive circuit 50 incorporates diode 60, resistor 62 combination, supplied via coupling of windings 64, 68. Lamp assembly 12 is provided with power from inverter circuit 10 by a coupling between windings 68 and 70, where winding 70 has a capacitor 72 across its length and are considered resonant load components. Windings 58 and 66 also serve as current limiting devices.

In the event of sudden load change, power Zener diodes 74 and 76 break down, clamping the voltage across the transistors (e.g., BJTS), to protect them from destruction.

With continuing attention to FIG. 2, breakover voltage of diac 32 is chosen to be proportional to an optimal ignition voltage of lamp assembly 12. In the illustrated embodiment, the breakover voltage of diac 32 is chosen to be such that when the bus voltage (the voltage across capacitors 34 and 36) reaches a predetermined value, for example about 390 V, diac 32 reaches its breakover voltage. Stated differently, start-up portion 24 detects when the bus voltage reaches the preferred firing voltage by virtue of the chosen breakover voltage of Zener diode 26 and diac 32. In the illustrated embodiment, the breakover voltage of the diac 32 is between 20 V and 40 V, and preferably about 32 V.

It is to be understood the above description that applies to first transistor 20 is also applicable to second transistor 22. That is, in an alternate inverter starting circuit embodiment, the start-up portion 24 is connected to second transistor 22, and it, instead of first transistor 20, would initiate oscillations.

Also, the preferred firing voltage may be chosen to be less than typical operating voltages for lamps in instant start and rapid start applications, which, in some instances, are approximately 450 V and 500 V, respectively. The firing voltage is also chosen to be about 300 V or greater.

Figure 3A:
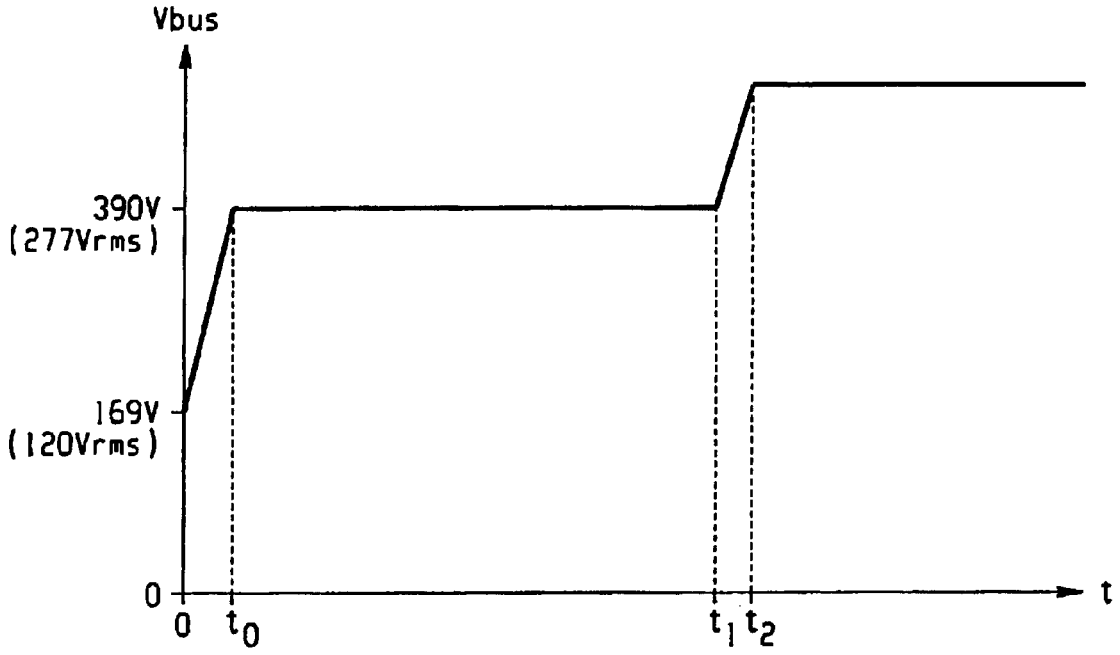
FIG. 3A shows the bus voltage over a time sequence for the rapid start electronic ballast according to the present application.
Figure 3B:
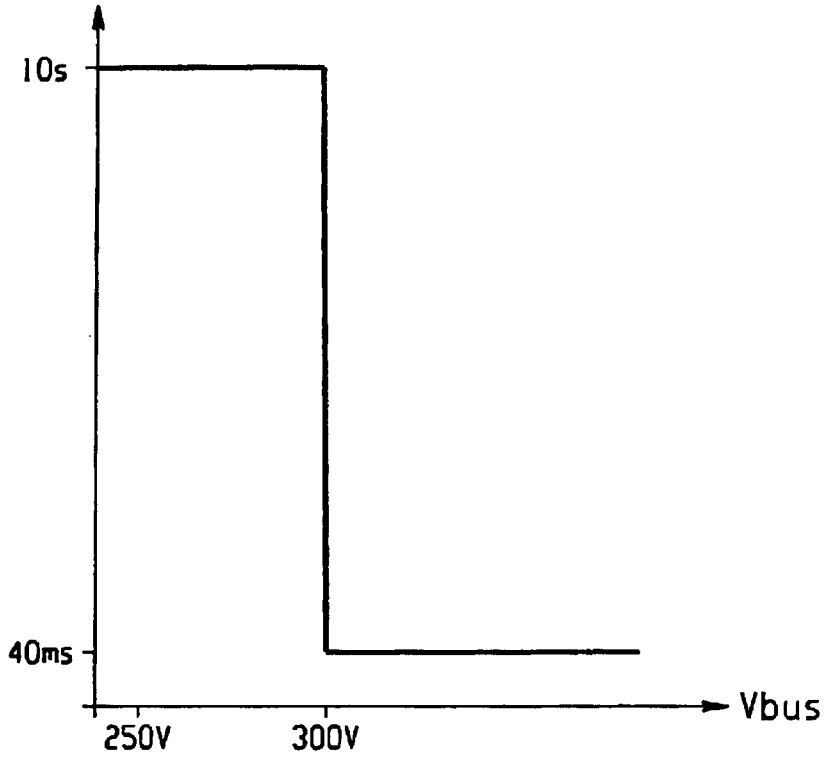
FIG. 3B provides a function of the bus voltage versus starting time for a rapid start electronic ballast according to the present application.

FIG. 3A provides a graphed time sequence of a rapid start electronic ballast incorporating inverter starting circuit 10 of the present application. As seen from this figure, the sequence includes three distinct transitions. From turn-on (0) to $t_0$ the bus voltage transitions from its starting voltage (e.g. 169 V) to a preferred pre-heat voltage (e.g. 390 V). The time duration to $t_0$–$t_1$ is a pre-heat time (e.g. steady 390 V), and from $t_1$ to $t_2$, the bus voltage ramps up to its steady state (e.g. 500 V). Turning attention to FIG. 3B, depicted is a chart showing inverter starting time for a rapid start electronic ballast incorporating inverter starting circuit 10. Viewing FIGS. 3A and 3B together emphasizes the starting time is controlled by the bus voltage of the circuit. For example if the bus voltage is less than 300 V, the inverter circuit will take approximately 10 seconds to start, however, when the bus voltage is 300 V or more, the start time is reduced to approximately 40 milliseconds. FIG. 3B illustrates the voltage dependency of the circuit, and emphasizes that operation to start the circuit is not a time dependent factor but is rather a voltage controlled concept. There is no pre-determined time following energization that the oscillations will begin. Rather, in the present design, following energization of the circuit, as long as the bus voltage is below a certain value (e.g. 300 V) there will, ideally, be no oscillations and only when the voltage is at or above the breakover voltage (e.g. 300 V) will the oscillations begin. Thus it is shown the starting of the circuit is controlled by the value of the bus voltage.

Figure 4:
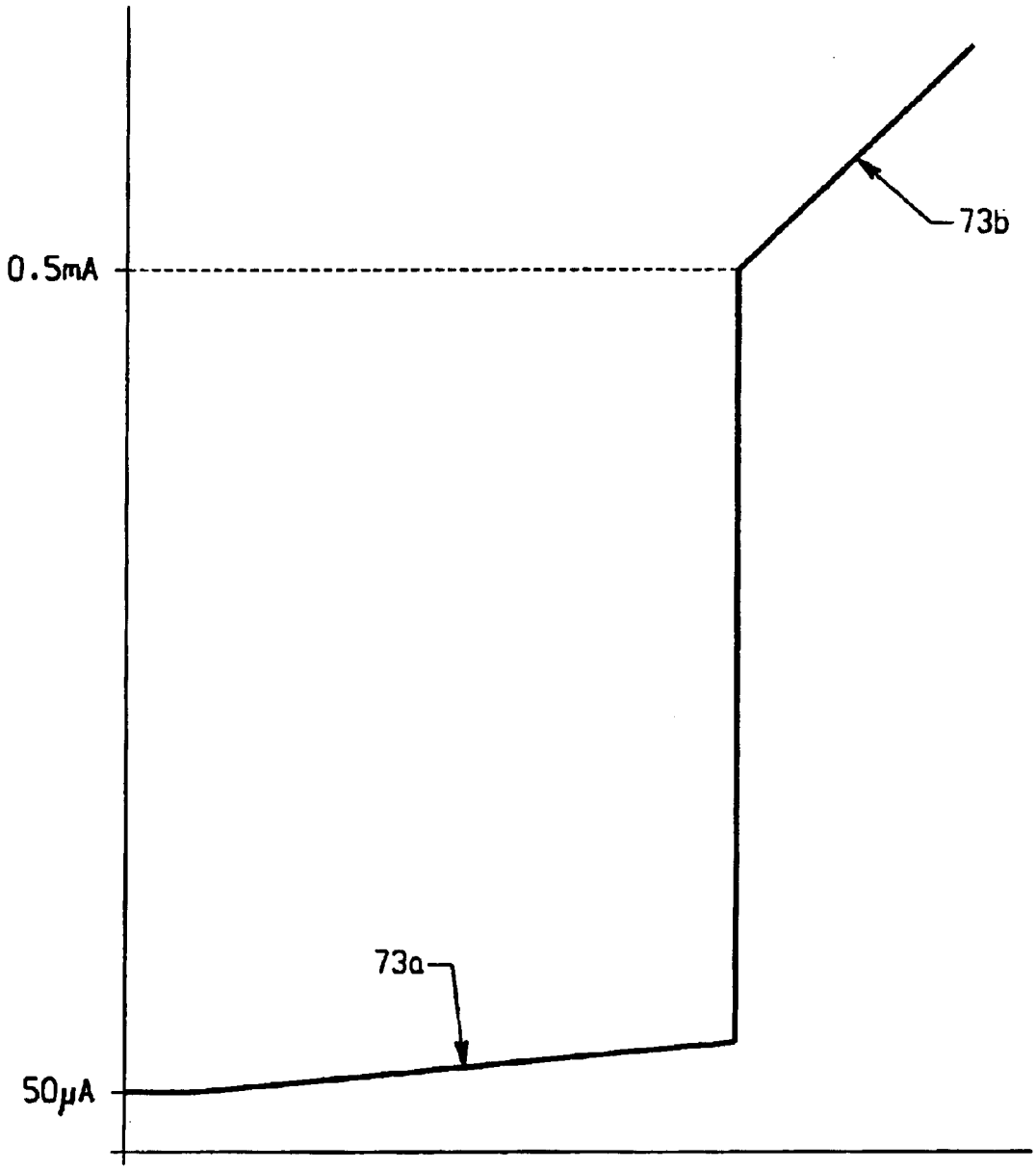
FIG. 4 depicts the charge current of capacitor 30 of FIG. 2 as a function of the bus voltage.

Turning now to FIG. 4, depicted is operation of charge capacitor 30 of FIG. 2, which illustrates its two distinct charging rates. Charge capacitor 30 will always have an amount of stored energy to be used for the breakover of diac 32. As seen, when the bus voltage is over 300 V, capacitor 30 charges at a very quick rate, and when below 300 V bus voltage, capacitor 30 is being charged only due to leakage current. Particularly, when the bus voltage is less than 300 V, Zener diode 26 never turns conductive in its reverse direction, and allows only a leakage current 73*a* to charge capacitor 30. After the bus voltage reaches 300 V, a significantly higher charging current 73*b* is available to capacitor 30.

Another consideration in selecting the threshold voltage is the starting bus voltage. For a 120 V line input, the output bus voltage ramps up from about 169 V. For a 277 V line input, the output bus voltage ramps up from about 390 V. As stated earlier, the start time (FIG. 3B) is about 40 milliseconds at 390 V. After inverter circuit is oscillating, the bus voltage continues to ramp up to steady state operating voltage V. Thus, one exemplary firing voltage is 390 V, because it is greater than the 300 V required for mode transition, is less than common steady state operating voltages, and triggers the inverter circuit as soon as possible, before the bus voltage reaches steady state. Of course, greater or lesser firing voltages can be chosen, based on known line voltages and desired universality of the inverter.

Returning to FIG. 2, attention is now drawn to the cathode cutoff or preheat control circuit (14, 16, 18). In this design, winding 70 and 68—in addition to being designed for resonant inductance—also provides isolation to the ballast. Secondary inductive winding 80 of winding arrangement 14 steps up the voltage to and provides isolation for switch circuit 16. Resonant winding 70 includes a gap with a relatively low magnetizing inductor. That inductor acts as a resonant component, resonating with capacitors 72 and 46 before the lamp starts. Additionally, capacitors 75, 77, and 78 reflected back to the primary side 70 after lamps of lamp assembly 12 are ignited. Winding 70 combined with capacitors 46, 72, 75, 77, and 78 determine one or multiple operating frequencies of the assembly A.

Inductor winding 80 is also tapped off of resonant inductor winding 70. Winding 80 supplies power to switching circuit primary winding 82. Winding 82 in turn supplies power to cathode windings 84, 86, 88, and 90. Cathode windings 84, 86, 88, and 90 pre-heat the cathodes of the lamps of lamp assembly 12. It is to be understood that cathode windings 84, 86, 88, and 90 act as the secondary of the primary winding 82. The primary winding has a higher number of turns and thus, a lower current is needed in the primary winding 82. Otherwise, costlier devices would be called for switching device 94 that can accommodate higher currents. Lower current devices are also desired to reduce power dissipation. Capacitor 92 limits the current that winding 80 supplies to primary winding 82. If the value of capacitor 92 is chosen to be sufficiently low, it limits the maximum current supplied to winding 82. Capacitor 92 serves a dual purpose; it acts as a DC blocking cap when transistor 94 is inactive. After a few cycles, this removes winding 82 from the circuit. That is, when transistor 94 goes inactive, no heating is being supplied to the cathodes. Diode 96 is connected back between capacitors 34 and 36 and protects transistor 94 from being supplied with excess voltage when transistor 94 goes inactive, during its transient state.

Winding arrangement 14 of FIG. 1 also includes an inductor winding 98, which supplies current through diode 100 and charges capacitor 102. Capacitor 102 is subject to the RC time constant defined by capacitor 106 and resistor 104. The time constant is selected to remove heating from the cathodes a safe time after lamp assembly 12 ignites, for example, it may be several seconds to 10 seconds or more after the inverter circuit is ignited. Capacitor 102 is connected to the gate of FET 108 via resistor 104. When the RC time constant defined by capacitor 106 and resistor 104 is fulfilled, charge developed on capacitor 102 causes FET 108 to become conductive. The gate of FET 94 is then brought down to a lower voltage level, causing FET 94 to become inactive. As stated previously, when FET 94 turns inactive, the voltage on the cathodes switch of circuit 16 is removed, thereby removing heating to the cathodes.

Transistors 94 and 108 are depicted as MOSFETs, but it is to be understood that a similar circuit architecture could be accomplished using bipolar junction transistors or other switching devices.

Figure 5:
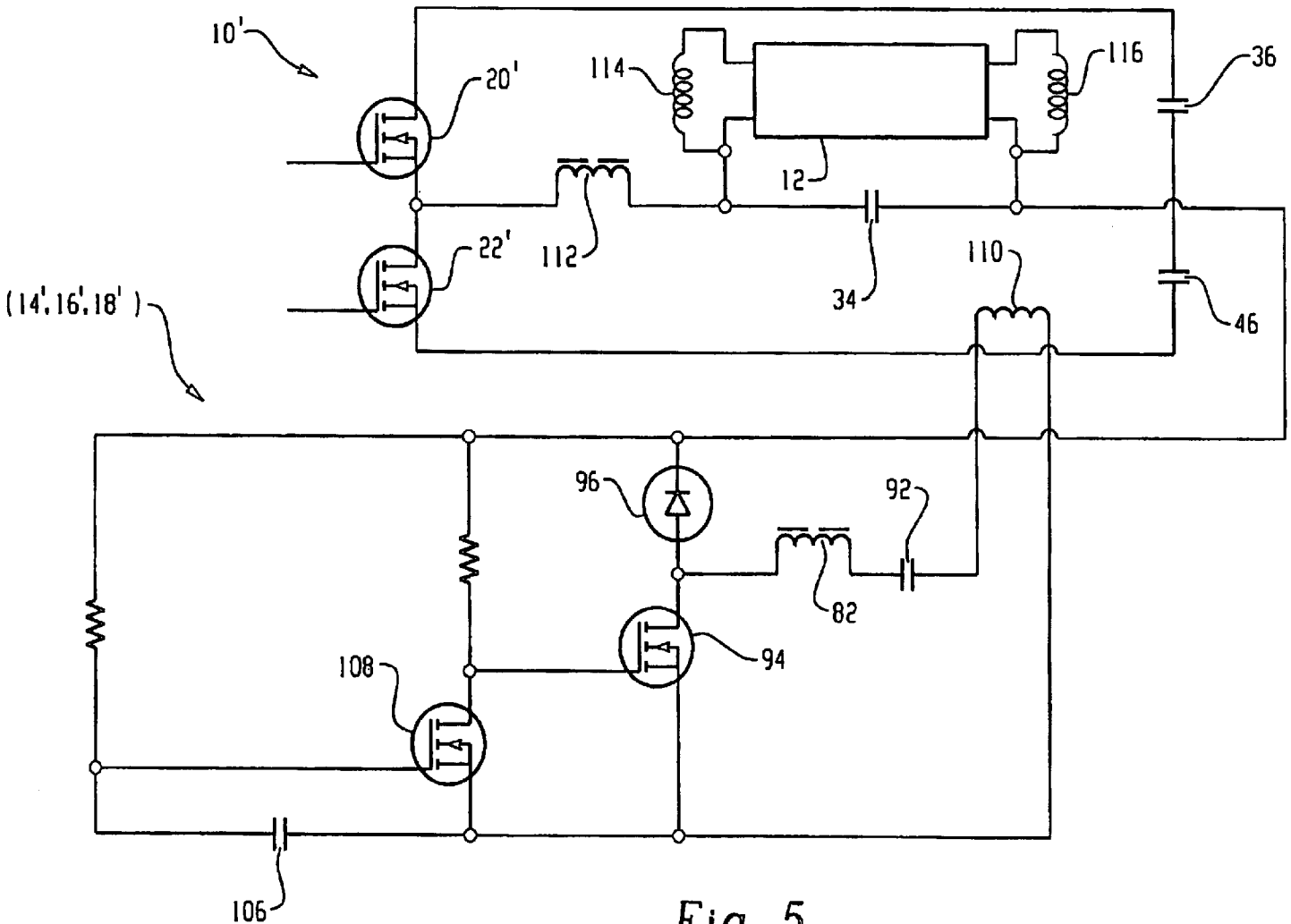
FIG. 5 shows an alternate architecture of a portion of the circuit of FIG. 2, with an additional winding tapped into the resonant inductor.

Turning to FIG. 5, depicted is an alternate cathode cut-off circuit 14', 16', 18' embodiment with a portion of a half bridge voltage fed rapid start electronic inverter 10'. The inverter 10' uses FET switches 20', 22'. This design incorporates an additional winding 110 tapped to resonant inductor 112. Power to the cathodes 114, 116 is derived from winding 110 on the resonant inductor 112 via capacitor 92 and primary winding 82 elements with similar functions to those in FIG. 2 are numbered similar to those in FIG. 2.

Thus, from the foregoing, it is shown (FIGS. 2 and 5) are two implementations of a new starting circuit in conjunction with current or voltage fed, half-bridge inverter circuits, which also implements a cathode cut-off circuit, which employs a unidirectional switching current design. The main bus voltage may be sensed by a three resistor divider circuit. A portion of the bus voltage is applied to a Zener diode and a charging capacitor. When the voltage reaches a predetermined level, the Zener diode breaks down, allowing the charging capacitor to 10 charge. A diac then breaks down, causing the self-oscillating inverter to be triggered. A diode prevents the charging capacitor from charging, allowing it to discharge every half-cycle, when a first transistor is on. The component values are selected such that the Zener breakdown voltage is at least double the diac breakdown voltage, or higher. The unidirectional switch circuit controls the energy delivered to the lamp cathodes, and current limiting capacitor prevents current from rising to dangerous levels. This protects the arrangement from possible miswirings, such as if one or more cathodes were shorted. Single unidirectional transistor switch 94 is turned on with zero voltage prior to oscillations of inverter transistors 20 (20) and 22 (22'), and turns off with zero current when the parasitic antiparallel diode of the FET—or a diode in parallel with the BJT—is conducting. Transistor 108 controls the removal of cathode heating after the lamp has started and stabilized. Possible applications of the present invention include General Electric's 4 ft. and 8 ft. T12 and T8 electronic lamp ballasts.

Additional embodiments of the described designs may be found in starting auxiliary power circuits when a main lamp is down. For example, with reference to FIG. 1, as shown by the dotted lines, the preheating circuit (14, 16, 18) may be used to provide auxiliary power when the main lamp (e.g., of assembly 12) has failed or is otherwise not in use. In this situation, an auxiliary lamp 120 may be connected to the preheat circuit (14, 16, 18). The auxiliary lamp may be a low-power fluorescent lamp, incandescent lamp or other lighting element. Therefore, in place of the additional windings 14, 18 being used to pre-heat the cathodes of lamp assembly 12, they are connected to the auxiliary lamp 120. This connection may be accomplished by the coupling of windings in a manner as discussed in connection with FIGS. 2 and 5 (e.g., winding 82), to provide power and control for the auxiliary lamp 120 or use a independent inverter circuit to power and control the auxiliary lamp. This design provides a very low cost control to the auxiliary lighting in part due to the use of a single switch (e.g., 94) control, in place of a two-switch system. The auxiliary lighting may be applicable 11 in a variety of situations such as back-up lighting and emergency lighting situations. Thus, instead of heating a cathode, the preheating circuit (14, 16, 18) may be used to deliver power to an auxiliary lamp 120.

Some exemplary component values for the circuits of FIGS. 2 and 5 are as follows:

| Part Description | Nominal Value | Nominal Value |
|---|---|---|
| Lamp Assembly | 10 | 40 Watts |
| Line Voltage | 11 | 120–277 Volts |
| First Transistor | 20 | BJT SPB 11NM60 |
| Second Transistor | 22 | BJT SPB 11NM60 |
| Bus Capacitor | 34 | 33 $\mu$f |
| Bus Capacitor | 36 | 33 $\mu$f |
| Bus Resistor | 38 | 400 k$\Omega$ |
| Bus Resistor | 40 | 620 k$\Omega$ |
| Bus Resistor | 42 | 1 M$\Omega$ |
| Diode | 28 | UF 4007 |
| Capacitor | 46 | 1.2 nf |
| Charging Capacitor | 30 | 0.1 uf |
| Diac | 32 | HT-32 |
| Zener Diode | 76 | P6KE440A |
| Base Diode | 52 | 1N5817 |
| Base Diode | 60 | 1N5817 |
| Base Resistor | 54 | 75 $\Omega$ |
| Base Resistor | 62 | 75 $\Omega$ |
| Inductive Winding | 58 | 5m Henries |
| Inductive Winding | 66 | 5m Henries |
| Inductive Winding | 70 | 0.85 mH |
| Inductive Winding | 68 | 1.27 mH |
| Capacitor | 72 | 0.01 uf |
| Zener Diode | 74 | P6KE440A |
| Capacitor | 75 | 0.0056 uf |
| Zener Diode | 26 | 68 V |
| Capacitor | 77 | 0.0056 uf |
| Capacitor | 78 | 0.0056 uf |
| Winding | 80 | 0.47 mh |
| Primary Cathode Winding | 82 | 1 mh |
| Secondary Cathode Winding | 84 | 2 uh |
| Secondary Cathode Winding | 86 | 2 uh |
| Secondary Cathode Winding | 88 | 2 uh |
| Secondary Cathode Winding | 90 | 2 uh |
| Capacitor | 92 | 4.7 nf |

It is to be understood that the foregoing components and values may be altered depending on the specific implementation, and values not listed may be selected in accordance with such implementations.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A lamp inverter circuit comprising:

a switching portion that converts a bus voltage signal into an alternating current signal;

an input portion that receives the bus voltage signal;

a resonant load portion for driving a lamp; and, a preheating portion that:

heats the lamp prior to ignition of the lamp; and, renders itself inactive after ignition of the lamp, wherein the preheating portion including a unidirectional switch used to control energy delivered to the at least one lamp, the unidirectional switch receiving an ac control signal prior to the ac control signal being converted into a pulsating dc signal.

2. The lamp inverter circuit as set forth in claim 1, wherein the cathode preheating portion includes an unidirectional switch used to control energy delivered to the at least one lamp.

3. The lamp inverter circuit as set forth in claim 2, wherein the inverter circuit is one of a voltage fed or current fed circuit.

4. The lamp inverter circuit as set forth in claim 2, wherein the unidirectional switch is a field effect transistor.

5. The lamp inverter circuit as set forth in claim 2, wherein the unidirectional switch is a bipolar junction transistor.

6. The lamp inverter circuit as set forth in claim 2, wherein the unidirectional switch detects if one of the lamp and the bus voltage signal has failed.

7. The lamp inverter circuit as set forth in claim 6, wherein the unidirectional switch ignites an auxiliary light source upon detection of failure of one of the bus voltage and the lamp.

8. The lamp inverter circuit as set forth in claim 6, further including a current limiting device to limit a maximum current, upon failure of the lamp.

9. The lamp inverter circuit as set forth in claim 2, wherein the unidirectional switch has a zero voltage turn-on point.

10. The lamp inverter circuit as set forth in claim 2, wherein the unidirectional switch has a zero current turn-off point.

11. The lamp inverter circuit as set forth in claim 2, wherein the preheating portion further includes a second switch, the second switch controlling a turning off of the preheating portion.

12. A method of starting a lamp comprising:

receiving a bus voltage signal;

converting the bus voltage signal into an alternating current signal;

preheating the lamp to an ignition temperature;

igniting the lamp; and inactivating the preheating after the lamp has been ignited.

13. The method as set forth in claim 12, further including: detecting a conductive state of the lamp.

14. The method as set forth in clamp 12, further including an independent inverter circuit used for the cathodes heating or an auxiliary lamp.

15. The method as set forth in claim 13, wherein the step of detecting includes detecting the conductive state of the lamp with the unidirectional switch, the unidirectional switch having a zero voltage turn-on point and a zero current turn-off point.

16. The method as set forth in claim 12, further including:

detecting if the lamp has failed.

17. The method as set forth in claim 16, further including: igniting an auxiliary lamp upon detection of failure of one of the lamp and/or all of the lamp load.

18. A method of igniting an auxiliary lamp comprising:

detecting a conductive state of a main lamp in a lamp ballast circuit with a switch that also controls preheating the main lamp;

detecting the integrity of the main lamp; and switching current flow from the main lamp to the auxiliary lamp in the event of a main lamp failure.

19. The method as set forth in claim 18, further including:

supplying auxiliary power to the auxiliary lamp in the event of lamp failure.

20. The method as set forth in claim 18, wherein the switch has a zero voltage turn-on point and a zero current turn-off point.

* * * * *

UNITED STATES PATENT AND TRADEMARK OFFICE

CERTIFICATE OF CORRECTION

PATENT NO. : 6,936,970 B2
DATED : August 30, 2005
INVENTOR(S) : Timothy Chen et al.

It is certified that error appears in the above-identified patent and that said Letters Patent is hereby corrected as shown below:

Column 8,
Lines 28-53, delete and insert the following:

2. The lamp inverter circuit as set forth in claim 1, wherein the inverter circuit is one of a voltage fed or current fed circuit.

3. The lamp inverter circuit as set forth in claim 1, wherein the unidirectional switch is a field effect transistor.

4. The lamp inverter circuit as set forth in claim 1, wherein the unidirectional switch is a bipolar junction transistor.

5. The lamp inverter circuit as set forth in claim 1, wherein the unidirectional switch detects if one of the lamp and the bus voltage signal has failed.

6. The lamp inverter circuit as set forth in claim 5, wherein the unidirectional switch ignites an auxiliary light source upon detection of failure of one of the bus voltage and the lamp.

7. The lamp inverter circuit as set forth in claim 5, further including a current limiting device to limit a maximum current, upon failure of the lamp.

8. The lamp inverter circuit as set forth in claim 1, wherein the unidirectional switch has a zero voltage turn-on point.

9. The lamp inverter circuit as set forth in claim 1, wherein the unidirectional switch has a zero current turn-off point.

10. The lamp inverter circuit as set forth in claim 1, wherein the preheating portion further includes a second switch, the second switch controlling a turning off of the preheating portion.

---

Column 8,
Lines 54-68, delete and insert the following:

11. A method of starting a lamp comprising:
receiving a bus voltage signal;
converting the bus voltage signal into an alternating current signal;
preheating the lamp to an ignition temperature;
igniting the lamp; and
inactivating the preheating after the lamp has been ignited, the preheating including unidirectional switching bya unidirectional switch which receives an ac control signal prior to the ac control signal being converted into a pulsating dc signal..

12. The method as set forth in claim 11, further including: detecting a conductive state of the lamp.

13. The method as set forth in clamp 11, further including an independent inverter circuit used for the cathodes heating or an auxiliary lamp.

---

UNITED STATES PATENT AND TRADEMARK OFFICE

CERTIFICATE OF CORRECTION

PATENT NO. : 6,936,970 B2
DATED : August 30, 2005
INVENTOR(S) : Timothy Chen et al.

It is certified that error appears in the above-identified patent and that said Letters Patent is hereby corrected as shown below:

Column 9,
Lines 1-10, delete and insert the following:

14. The method as set forth in claim 12, wherein the step of detecting includes detecting the conductive state of the lamp with the unidirectional switch, the unidirectional switch having a zero voltage turn-on point and a zero current turn-off point.

15. The method as set forth in claim 11, further including:
detecting if the lamp has failed.

16. The method as set forth in claim 15, further including: igniting an auxiliary lamp upon detection of failure of one of the lamp and/or all of the lamp load.

Lines 11-13, delete and insert the following:

17. A method of igniting an auxiliary lamp comprising:
detecting a conductive state of a main lamp in a lamp ballast circuit with a switch that also controls preheating the main lamp;
detecting the integrity of the main lamp; and
switching current flow from the main lamp to the auxiliary lamp in the event of a main lamp failure.

Column 10,
Lines 1-13, delete and insert the following:

18. The method as set forth in claim 17, further including:
supplying auxiliary power to the auxiliary lamp in the event of lamp failure.

19. The method as set forth in claim 17, wherein the switch has a zero voltage turn-on point and a zero current turn-off point.

Signed and Sealed this

Sixth Day of December, 2005

JON W. DUDAS
*Director of the United States Patent and Trademark Office*